US007017739B2

(12) United States Patent
Barham et al.

(10) Patent No.: US 7,017,739 B2
(45) Date of Patent: Mar. 28, 2006

(54) LOCKING TROWEL COVERS

(76) Inventors: William Gene Barham, 0568 Green Mountain Dr., Eagle, CO (US) 81631; John W. Barham, 942 Lookout Dr., Glenrock, WY (US) 82637

( * ) Notice: Subject to any disclaimer, the term of this patent is extended or adjusted under 35 U.S.C. 154(b) by 182 days.

(21) Appl. No.: 10/141,738

(22) Filed: May 9, 2002

(65) Prior Publication Data

US 2002/0166784 A1 Nov. 14, 2002

Related U.S. Application Data

(63) Continuation-in-part of application No. 09/851,047, filed on May 8, 2001, now Pat. No. 6,491,162.

(51) Int. Cl.
*A45C 11/26* (2006.01)

(52) U.S. Cl. ..... 206/349; 206/38

(58) Field of Classification Search ..... 206/349, 206/372, 373, 38, 39, 39.5; 15/231, 147.1, 15/235.4; 150/161, 154
See application file for complete search history.

(56) References Cited

U.S. PATENT DOCUMENTS

| | | | | |
|---|---|---|---|---|
| 2,190,811 | A | 2/1940 | Van Zeeland | |
| 2,517,649 | A | 8/1950 | Frechtmann | |
| 2,528,059 | A | 10/1950 | Kendrick | |
| 2,952,028 | A | 9/1960 | Robbins | |
| 3,710,929 | A * | 1/1973 | Morales | 221/279 |
| 5,020,255 | A * | 6/1991 | Rodel | 40/654 |
| 5,530,984 | A | 7/1996 | Walker | |
| 5,592,767 | A * | 1/1997 | Treske | 40/649 |
| 5,632,569 | A * | 5/1997 | Szmansky | 404/97 |
| 5,938,010 | A * | 8/1999 | Osterbye | 206/38 |
| 6,585,112 | B1 * | 7/2003 | Levin et al. | 206/39 |

OTHER PUBLICATIONS

International Search Report for International Application PCT/US02/14466.

* cited by examiner

*Primary Examiner*—Shian T. Luong
(74) *Attorney, Agent, or Firm*—Patent Law Offices of Rick Martin, P.C.

(57) ABSTRACT

Plastering/cement trowels have sharp edges which can cut a worker when he places the trowel down in a resting position. The present invention provides a plastic sheath to insert the trowel into during the resting mode of use. This sheath also prevents nicks and dents to the trowel while it is transported. An optional sharpening file is attached to the top of the sheath. Various sheath embodiments include a narrowed rear section of a longitudinal slot on the upper member which functions to hold the spine of the trowel in the slot, a rubber membrane stretchable over the blade, a pair of pincer members on the top of the sheath to lock the shank of the trowel into the sheath, a tether on top of the sheath to lock the shank of the trowel into the sheath, and a rear door for the blade slot.

22 Claims, 8 Drawing Sheets

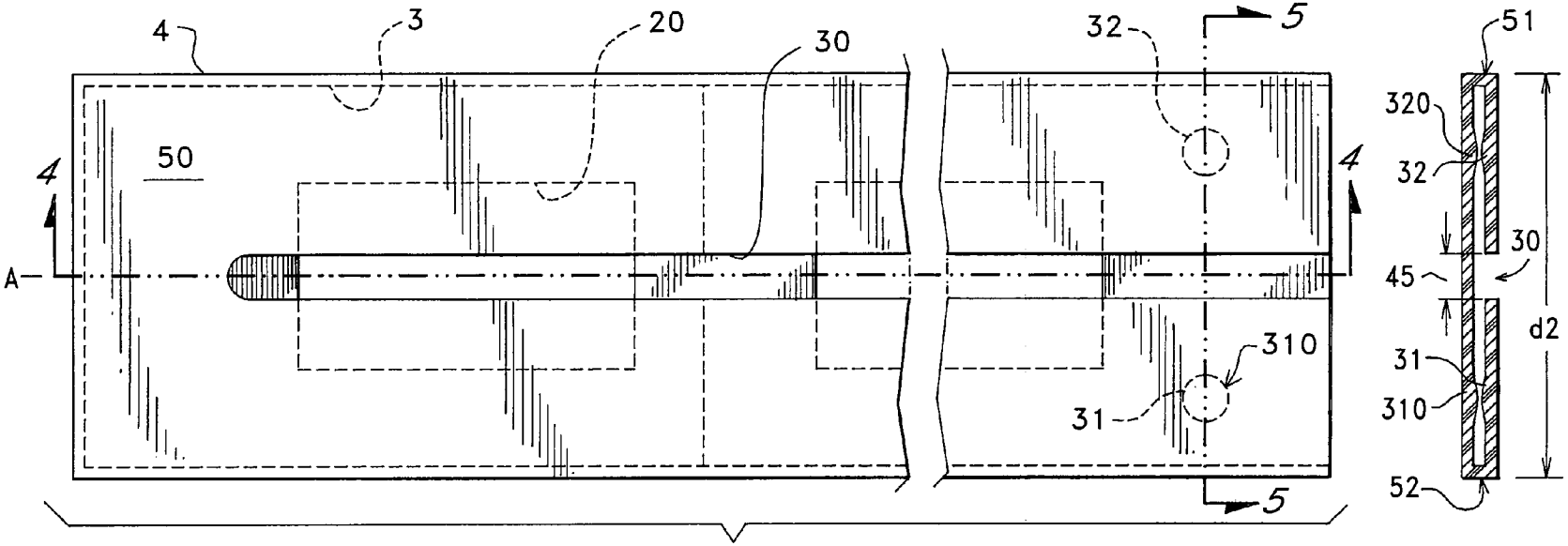
FIG. 3
FIG. 5
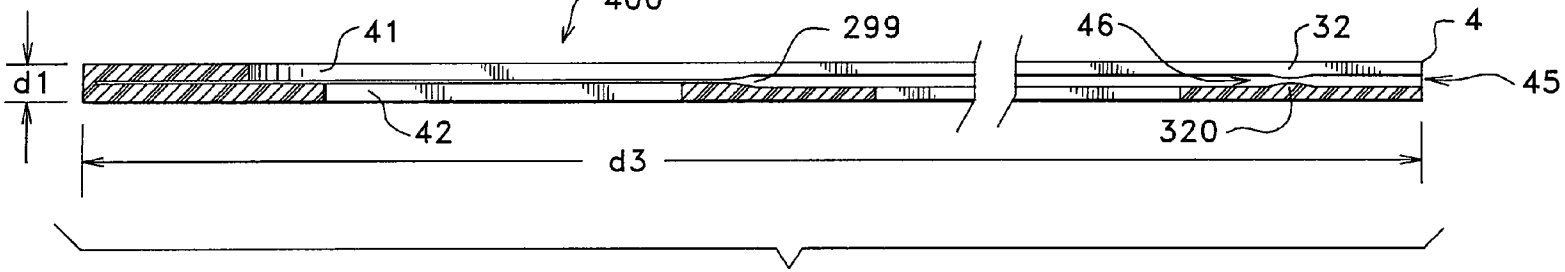
FIG. 4

LOCKING TROWEL COVERS

CROSS REFERENCE PATENTS

The present invention is a Continuation-in-Part of U.S. patent application Ser. No. 09/851,047, filed May 8, 2001, issued as U.S. Pat. No. 6,491,162 on Nov. 14, 2002.

FIELD OF INVENTION

The present invention relates to slip on plastic or rubber covers for a cement and plastering trowel.

BACKGROUND OF THE INVENTION

A cement/plastering trowel will be called a mason's trowel herein. A mason's trowel has a rectangular working surface which is slightly convex running along a longitudinal axis of the working surface. The outside longer edges curve upward.

Noted below are references which tried but failed to provide a protective sheath for the mason's trowel.

U.S. Pat. No. 2,952,028 (1960) to Robbins discloses a mason's trowel guard made of metal. The inside gripping edges are coarse so as to sharpen the long side edges of the trowel.

U.S. Pat. No. 2,190,811 (1940) to Zeeland discloses a rubber and felt cover stretched over the bottom of a triangular trowel to provide a smooth working surface for the blade in plastering applications.

U.S. Pat. No. 2,528,059 (1948) to Kendrick discloses a knife sheath having a release catch.

U.S. Pat. No. 2,517,649 (1949) to Frechtmann discloses a knife blade guard made of a plastic rod having a slot to receive the blade.

What is needed in the art is a flexible sheath for a mason's trowel which will not fall off from any angle during transport. Another needed feature is a sheath with drainage holes for washing with water. Another needed feature is a sheath having a built in file for sharpening the blade. The present invention provides all of these features, which are deemed new, useful and non-obvious in the art.

SUMMARY OF THE INVENTION

The primary aspect of the present invention is to provide a sheath for a mason's trowel that grasps the blade of the trowel so as not to fall off from any angle during transport.

Another aspect of the present invention is to provide the sheath with water drain holes.

Another aspect of the present invention is to provide the sheath with a file to sharpen the trowel.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 3 is a top plan view of the sheath shown in FIG. 1 with section arrows, and without the trowel.

FIG. 4 is a longitudinal sectional view of the sheath taken along lines 4—4 of FIG. 3.

FIG. 5 is a cross sectional view of the sheath taken along lines 5—5 of FIG. 3.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
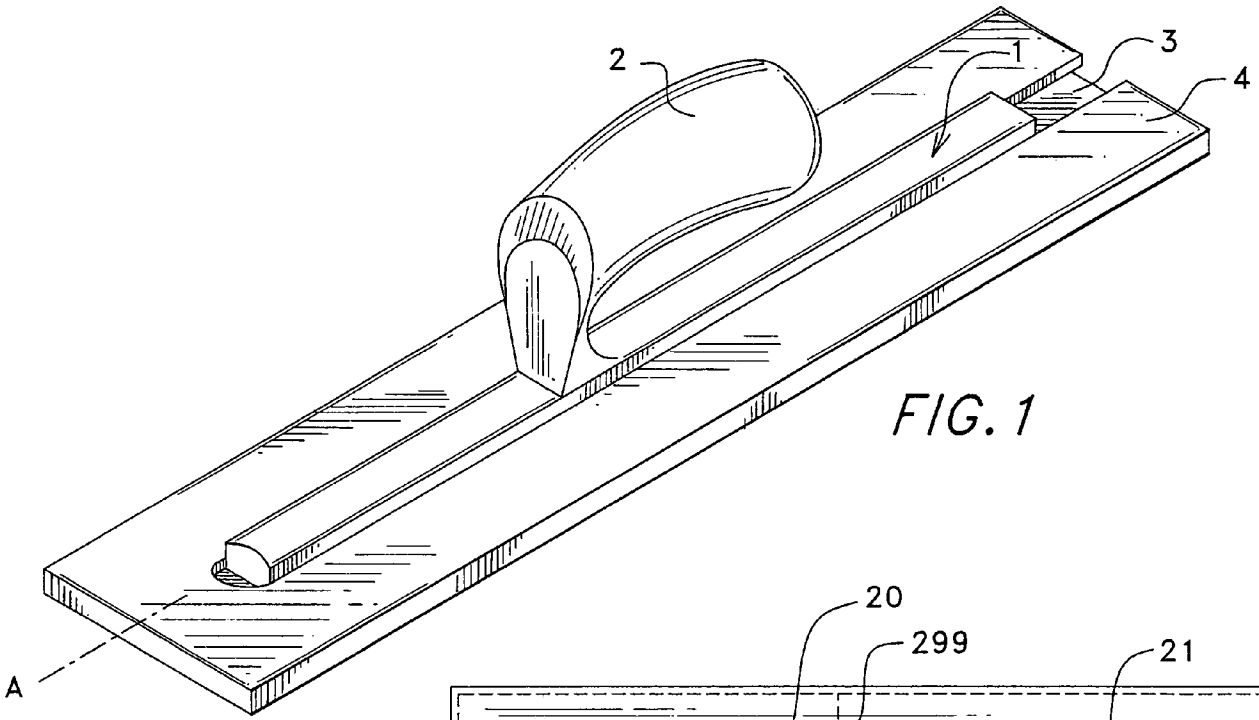
FIG. 1 is a top perspective view of an alternate embodiment sheath covering a mason's trowel, and shown not sliding off even with the trowel pointed down.

Referring first to FIG. 1 a mason's trowel 1 has a handle 2, a blade 3, and a spine 199. The blade 3 is shown as rectangular in shape, but other shapes such as triangular are encompassed by this invention. A sheath 4 has a longitudinal axis A.

Figure 2:
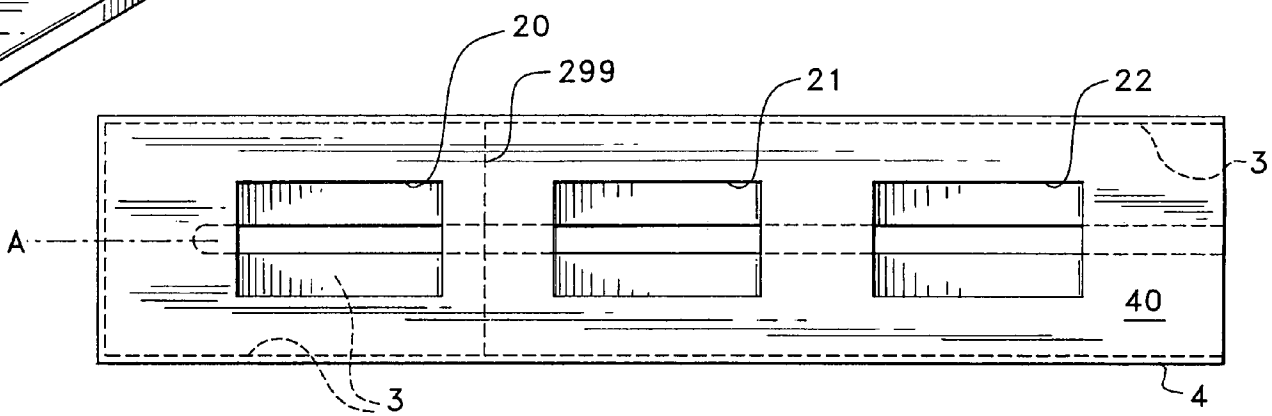
FIG. 2 is a bottom plan view of the sheath shown in FIG. 1 without the trowel.

Referring next to FIG. 2 this blade 3 is shown in dots as well as through the holes 20, 21, 22 which are formed in the bottom surface 40 of the sheath 4. These holes 20, 21, 22 provide for water drainage if a hose is used to clean the blade 3 while sheathed, as well as to prevent standing water from rusting the blade. The dotted line 299 indicates the proximal end of the jaw members 41, 42.

Referring next to FIG. 3 the sheath 4 has a top surface 50. A receiving slot 30 for the trowel handle is formed in the top surface 50. Proximal clamps 31, 32 to secure the blade are shown in dots.

Referring next to FIG. 4 the sheath 4 has at its distal end an internal jaw 400 to grasp the distal end of the blade 3. Jaw 400 has an upper jaw member 41 and a lower jaw member 42. The blade 3 spreads the jaw members apart about one millimeter, thereby providing a grip from the jaw 400 to the blade 3. A space 45 of about ⅛ inch runs along the length of the sheath 4 until the jaw 400 begins. A pair of proximal clamps 32/320 and 31/310 grip the proximal end of the blade 3. The gap 46 between clamp members 32 and 320 and 31 and 310 is sized at slightly less than the gauge of the blade 3. The sheath 4 is preferably made of plastic with a spring memory. Nominal dimensions are $d_1$=⅜" $d_2$=5", $d_3$=20.5", $d_4$=4", $d_5$=1", and $d_6$=¼".

Referring next to FIG. 5 it is shown how openings 51, 52 sized at about ⅛ inch receive the blade edges (FIG. 9, 90, 91) without any need to pry the sheath opening 45 open. The blade 3 is slightly convex pointing downward as shown in FIG. 9.

Figure 6:
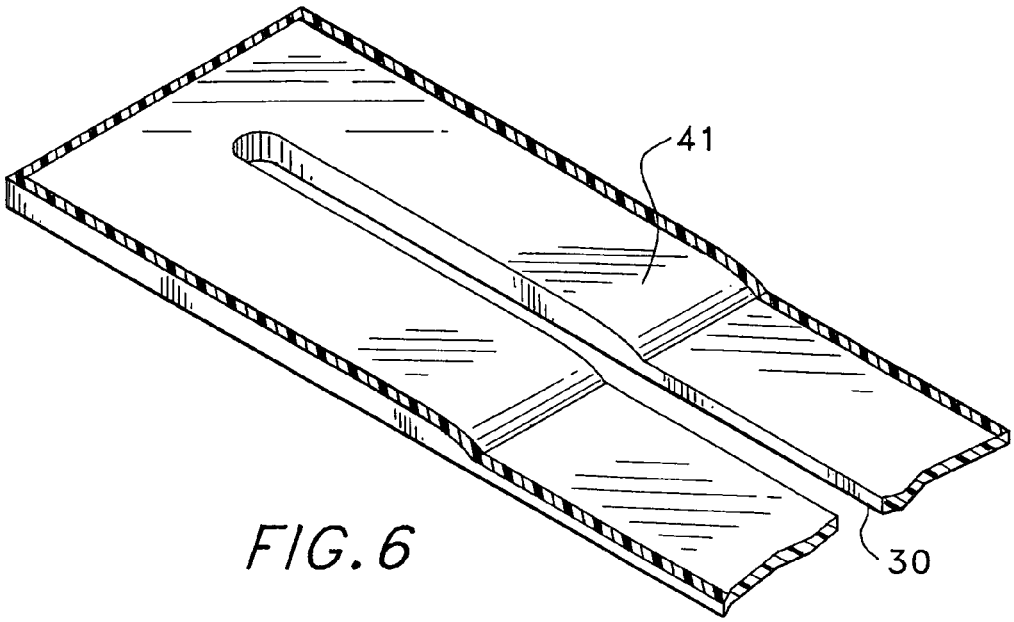
FIG. 6 is a bottom perspective view of the top distal gripping member of the sheath.
Figure 7:
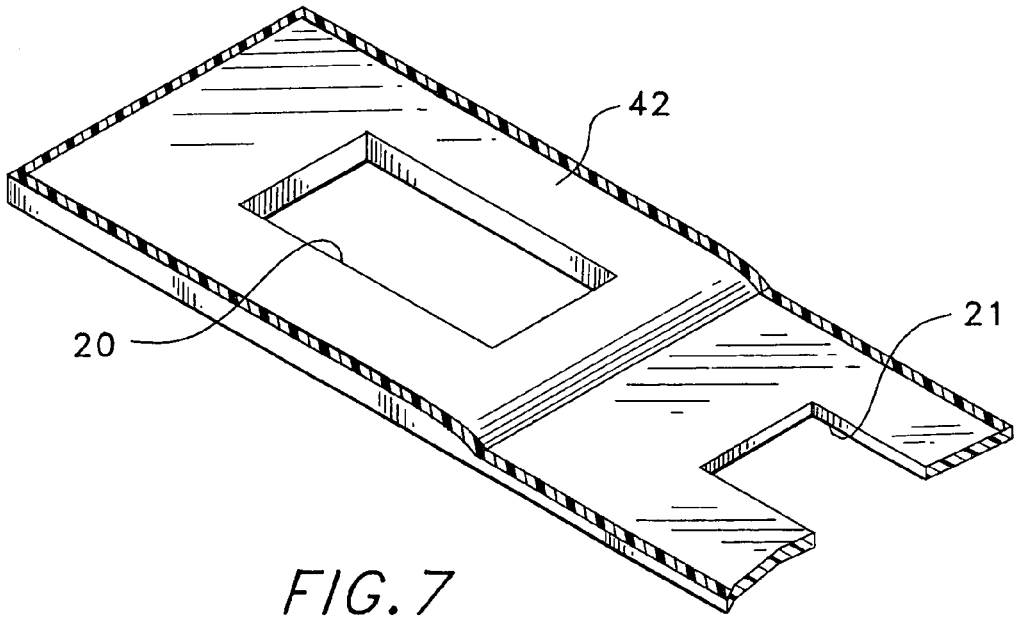
FIG. 7 is a top perspective view of the bottom distal gripping member of the sheath.

FIGS. 6, 7 show the jaw members 41, 42 which by themselves can grip the blade 3 and prevent the sheath 4 from falling off at any angle of transport, as best shown in FIG. 1.

Figures 8, 9:
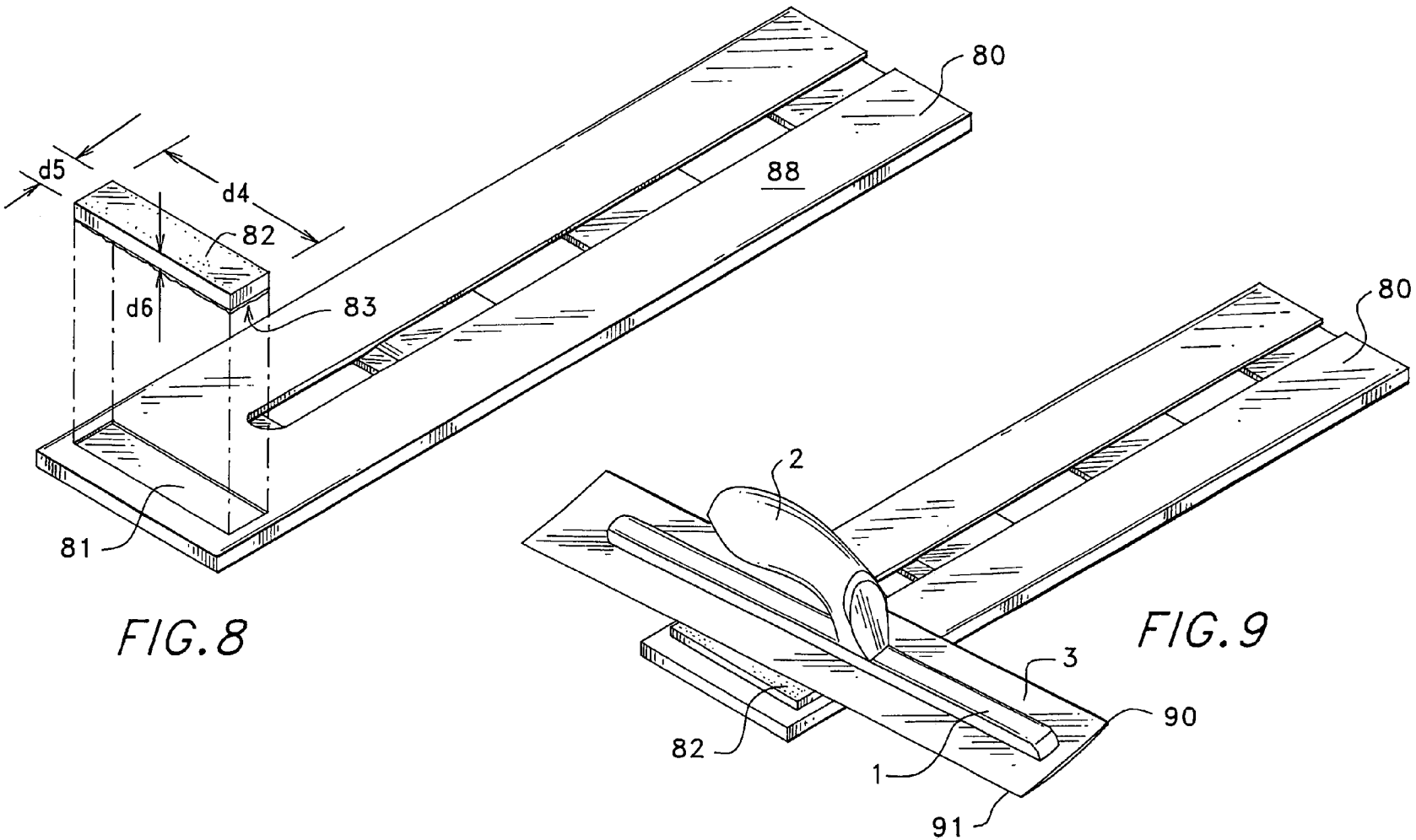
FIG. 8 is an exploded view of an alternate embodiment sheath having a file.
FIG. 9 is a top perspective view of the FIG. 8 embodiment with a trowel being sharpened on the file.

Referring next to FIGS. 8, 9 a sheath 80 has a mounting hole 81 on its top surface 88. A file 82 with glue 83 is secured into hole 81. The trowel blade 3 is shown sharpened along file 82.

Figures 10, 11:
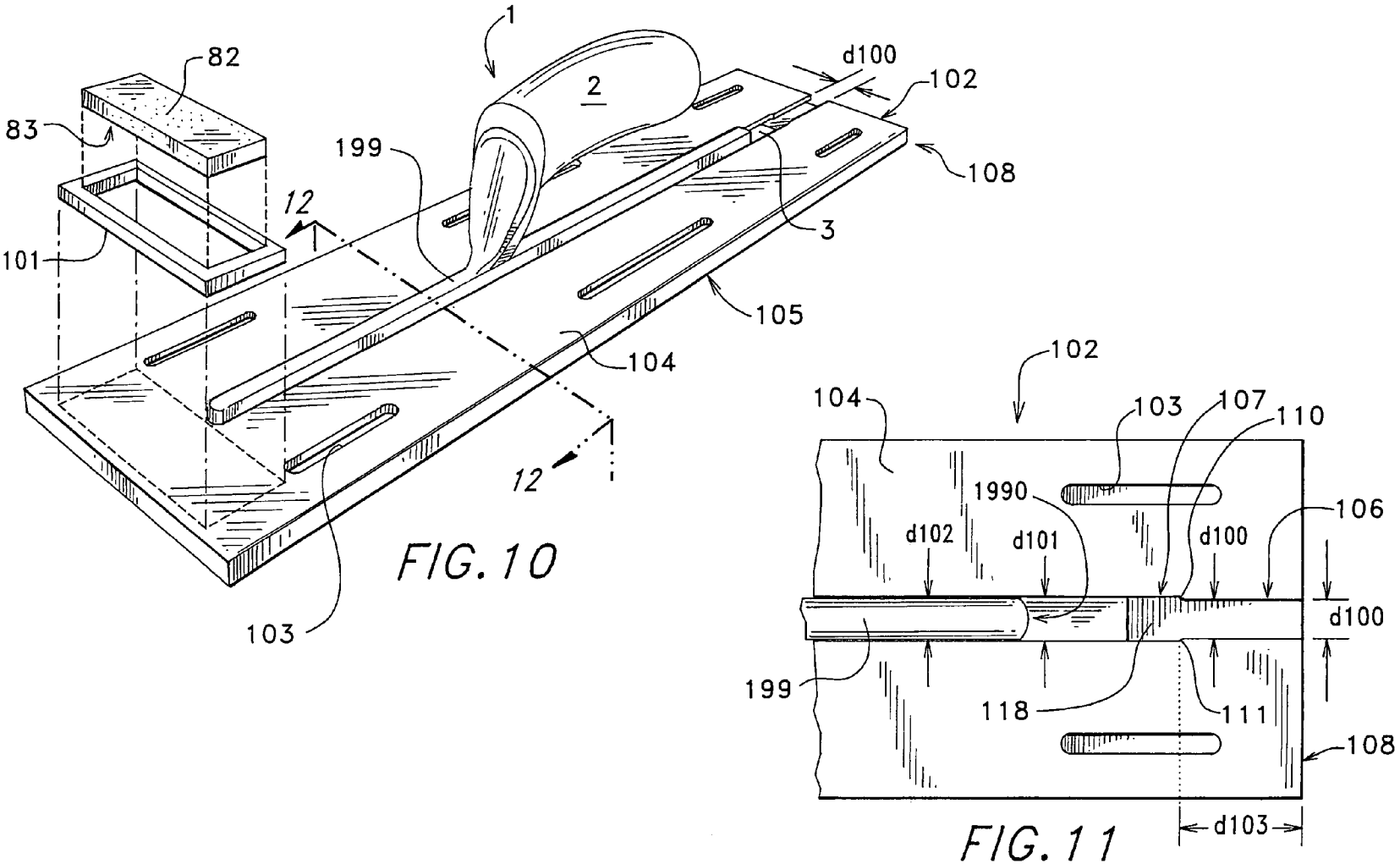
FIG. 10 is a top perspective view of the preferred embodiment trowel cover.
FIG. 11 is a close-up top plan view of the rear portion of the FIG. 10 embodiment.
Figure 12:
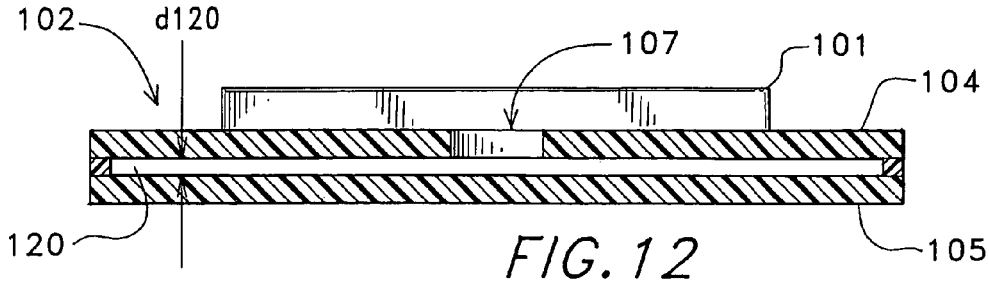
FIG. 12 is a cross sectional view taken along line 12—12 of FIG. 10.

Referring next to FIGS. 10, 11, 12 the trowel 1 is protected by the sheath 102, the preferred embodiment. The sheath 102 is made preferably of plastic. A top surface is labeled 104, and a bottom surface is labeled 105. Slots 103 project through both the top surface 104 and bottom surface 105 to allow water to drain from the sheath. The sheath 102 has a rear end 108 having a slot 120 to receive the trowel blade 3. The slot 120 has a uniform height $d_{120}$ sized to accommodate a chosen blade 3. There is no jaw at the distal end as in the FIG. 1 embodiment. The clamping mechanism comprises a longitudinal slot 107 that has a width $d_{101}$, wherein $d_{101}$ is slightly larger than the spine 199 width of $d_{102}$. The slot 107 has a rear end taper at points 110, 111, wherein points 110, 111 form a pincer-type stop against the rear end 1990 of the spine 199. Thus, the sheath 102 is held onto the trowel 1 by means of the spine rear end 1990 hitting the stops 110, 111. The rear end of the slot 107 narrows to width $d_{100}$ and length $d_{103}$ along section 106. Section 106 can be sized along the longitudinal axis of the sheath 102 to end adjacent to the rear end 1990 when the blade 3 is fully inserted into the sheath 102. By sizing this section 106 in this manner, the trowel cannot rattle in the space 118 between the stops 110, 111 and the rear end 1990. In any case several different trowels with different length spines can be accommodated with this embodiment because the rattling of the trowel 1 in the sheath 102 is rather incidental. In reality, the sheath is placed on the trowel, and then the trowel is placed in a bucket or in a storage space. An optional file 82 is shown held in frame 101 by glue 83.

Figure 13:
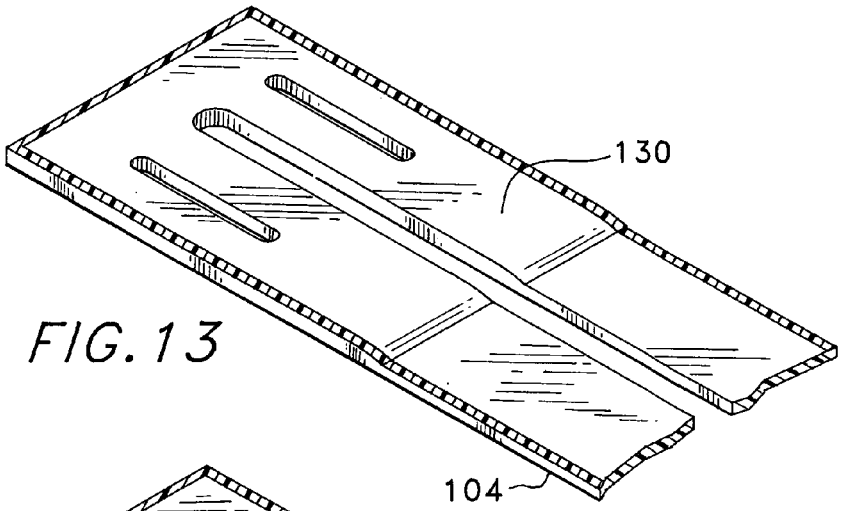
FIG. 13 is a bottom perspective view of a top distal jaw member of an alternate embodiment trowel cover that has both the clamp of FIG. 11 and a jaw similar to the embodiment of FIGS. 1, 6, 7.
Figure 14:
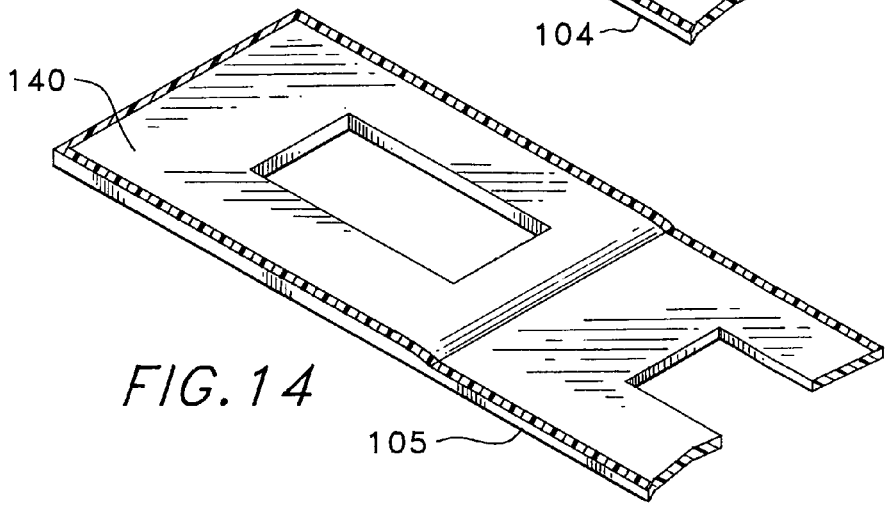
FIG. 14 shows the embodiment of FIG. 13 in a top perspective view of the bottom distal jaw member.

Referring next to FIGS. 13, 14 another embodiment of the sheath is shown to be identical to the FIG. 10 embodiment with the addition of jaw members 130, 140. These jaw members 130, 140 form a distal clamp for the front of the blade 3. Various size blades can be accommodated by this combination jaw and spine stop embodiment with the additional feature that the jaw members will prevent rattling of the blade in the sheath.

Figure 15:
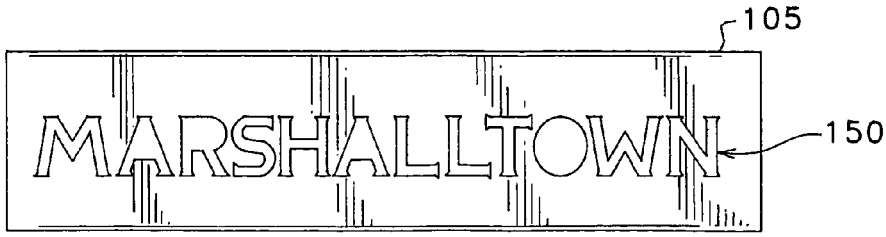
FIG. 15 is a bottom plan view of another alternate embodiment showing how any of the embodiments herein can be adapted to marketing purposes.

Referring next to FIG. 15 all embodiments herein have a bottom surface 105. Holes in the bottom surface 105 allow water to drain away from the trowel, thereby reducing rust. It is illustrated that the holes 150 can be used for advertising purposes. The holes 150 could be shaped into any desired indicia. Marshalltown is a registered trademark of a trowel manufacturer.

Figure 16:
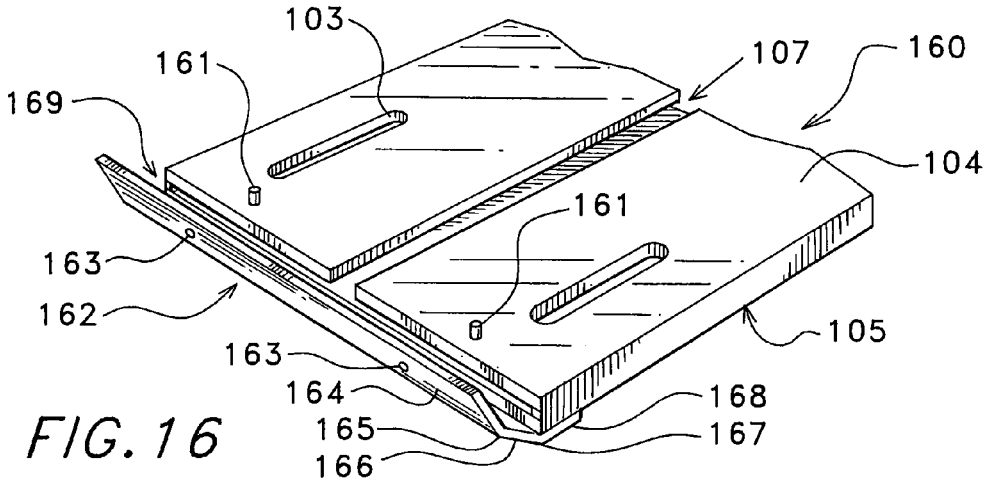
FIG. 16 is a rear perspective view of another alternate embodiment having a rear door to hold the cover onto the trowel.
Figure 17:
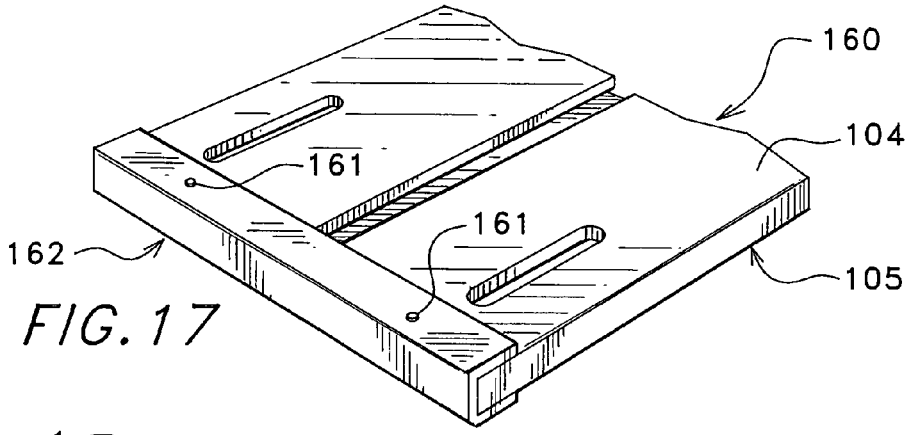
FIG. 17 is the same view as FIG. 16 showing the rear door closed.

Referring next to FIGS. 16, 17 another alternate embodiment sheath 160 is shown to have a spine slot 107 which does not necessarily have the stops 110, 111 shown in FIG. 11. The blade (not shown) is held into the sheath 160 with a door 162. This particular door shown is a plastic folding door having a bottom panel 168 fastened to the bottom 105. A fold line 167 connects the bottom panel 168 to the center panel 166. Another fold line 165 connects the center panel to the top panel 164. The top panel 164 snaps onto the top 104 by means of holes 163 snapping onto studs 161. FIG. 17 shows the door 162 closed. Any sized blade can fit in the sheath 160. Optional distal jaw members could also be added to this embodiment. An equivalent to door 162 would be any closure device over the rear entry slot 169, including a hinged flap, a bungee cord, movable studs that close the slot 169 and/or a sliding door.

Figure 18:
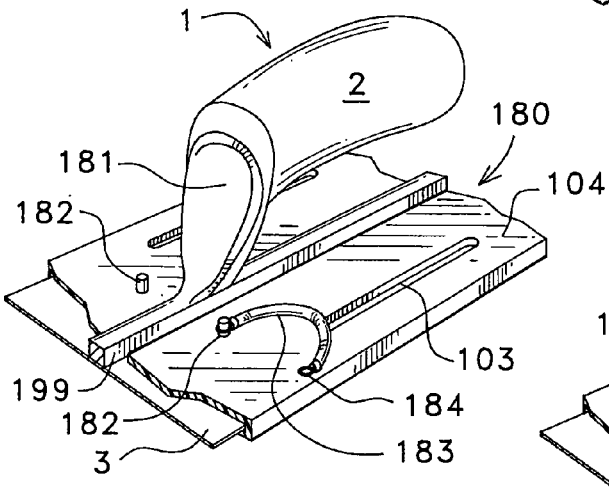
FIG. 18 is a top perspective view of another alternate embodiment having a tether holding the shank of the trowel handle in the sheath.
Figure 19:
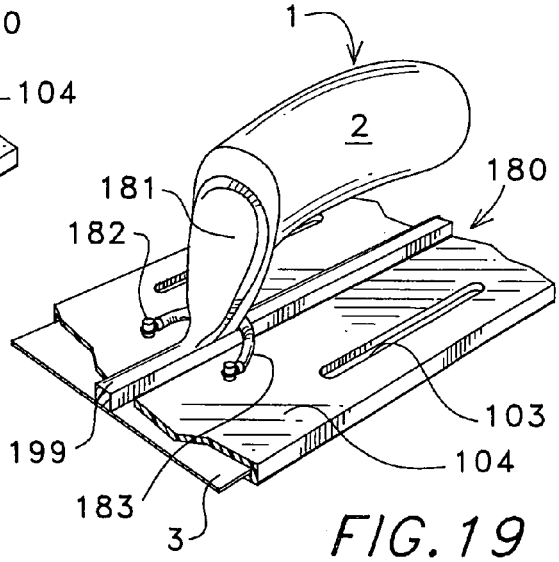
FIG. 19 is the same view as FIG. 18 showing the tether in the closed position.

Referring next to FIGS. 18, 19 another embodiment of a sheath 180 holds the trowel 1 in the sheath by means of locking the shank 181 of the handle 2 into the sheath 180. This embodiment uses studs 182 which may have a groove (not shown) to hold a clip 184 at one end of a tether 183. The opposite end of the tether 183 from end 184 may either be removable as end 184 or fixed to the stud 182. In any case at least one end of the tether 183 can be removably secured around the shank 181 to hold the trowel 1 into the sheath 180.

Figure 20:
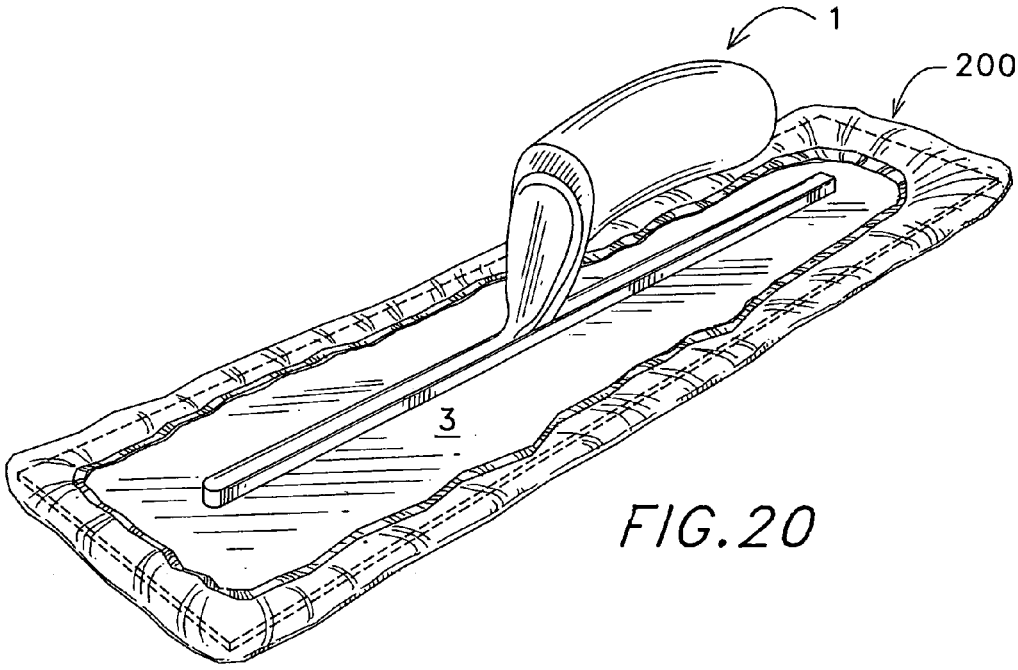
FIG. 20 is a top perspective view of another alternate embodiment which consists of a flexible sock-like cover that is pulled over the blade of the trowel.

Referring next to FIG. 20 another alternate embodiment sheath 200 is formed of a stretchable material such as rubber. The size of the sheath 200 is chosen to form fit over a blade 3 like a rubber slipper over a foot.

Figure 21:
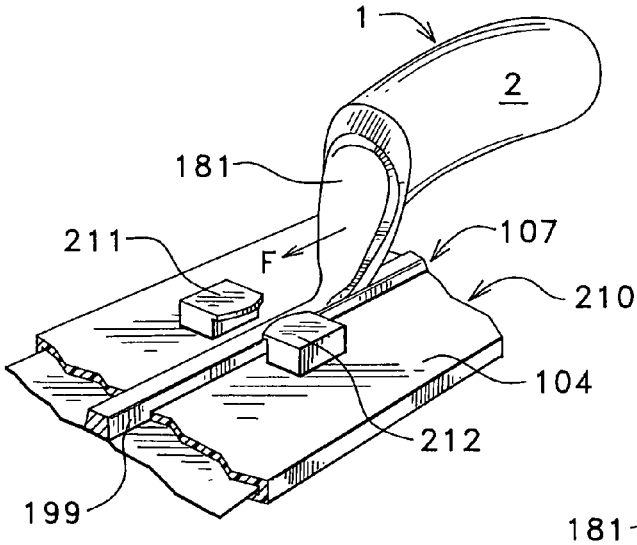
FIG. 21 is a top perspective view of another alternate embodiment sheath that has a pair of stops which lock the shaft of the trowel handle into the sheath.
Figure 22:
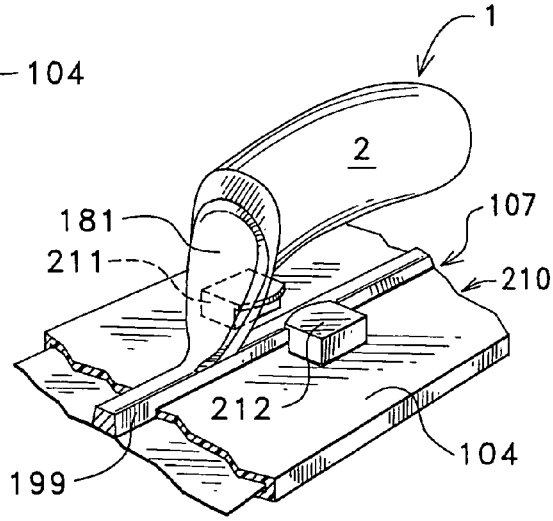
FIG. 22 is the same view as FIG. 21 with the shank locked into the sheath via the stops.

Referring next to FIGS. 21, 22 another alternate embodiment sheath 210 locks the trowel 1 into the sheath 210 by means of locking the shank 181 of the handle 2 into the sheath 210. The top 104 of the sheath 210 has a pair of stops 211, 212 through which the shank 181 passes when the trowel is slid into the sheath 210 in direction F. The space between the stops 211, 212 is slightly smaller than the width of the shank 181. The user can overcome the pincer force applied by the stops as he moves the shank 181 in direction F. However, the mere weight of the sheath 210 cannot overcome the pincer force of the stops 211, 212. For purposes of keeping the sheath 210 on the trowel during normal transport, the stops 211, 212 are adequate. Also by placing the stops 211, 212 at a chosen location along slot 107 various styles of trowels can be accommodated by the sheath 210.

Although the present invention has been described with reference to preferred embodiments, numerous modifications and variations can be made and still the result will come within the scope of the invention. No limitation with respect to the specific embodiments disclosed herein is intended or should be inferred.

We claim:

1. In combination with a mason's trowel, the trowel having a flat blade with a length 1, a longitudinal axis, a handle connected to an upper surface of the blade, an improvement comprising:

a sheath having a length of at least 1;

the sheath having a receiving slot for the blade;

the sheath having an upper and a lower surface;

the upper surface having a longitudinal slot to receive a spine of the trowel;

wherein at least one inner surface of said longitudinal slot borders said spine whereby the upper surface of the sheath encases the blade;

the longitudinal slot having a stop to lock a rear end of the spine into the longitudinal slot; and wherein the stop further comprises a narrowed rear portion of the longitudinal slot.

2. The apparatus of claim 1, wherein the lower surface further comprises at least one hole, thereby allowing water to drain therethrough.

3. The apparatus of claim 2, wherein the sheath has a file connected to an outside surface thereof.

4. The apparatus of claim 1, wherein the trowel and the sheath each have a rectangular shape.

5. The apparatus of claim 1, wherein the sheath has a construction of plastic.

6. The apparatus of claim 1, wherein the sheath has a file connected to an outside surface thereof.

7. The apparatus of claim 1, wherein the sheath has a file connected to an outside surface thereof.

8. A sheath for a mason's trowel, said sheath comprising:

a rectangular shaped block having a size larger than a trowel;

a slot in the block sized to receive a blade of the trowel without any prying open of the slot;

the sheath having an upper member with a longitudinal slot to receive a handle of the trowel;

wherein at least one inner surface of said longitudinal slot borders said spine whereby the upper member of the sheath encases the blade; and the longitudinal slot having a narrowed rear portion which forms a pair of stops to lock a rear end of a spine of the trowel into the longitudinal slot.

9. The sheath of claim 8, wherein the sheath has a lower member with at least one drain hole.

10. The sheath of claim 8, wherein the sheath further comprises a file attached to an outer surface.

11. A sheath for a mason's trowel, the sheath comprising:

a body means functioning to protect a blade of a trowel;

a slot means at a rear end of the body means functioning to receive the blade of the trowel;

said body means having an upper member with a longitudinal slot means functioning to receive a spine of the trowel;

wherein at least one inner surface of said longitudinal slot means borders said spine functioning to allow the upper member of the body means to encase the blade;

said longitudinal slot means further comprising a stop means functioning to prevent a rear end of the spine from passing through the stop means without a pushing force on the trowel; and wherein the stop means further comprises a narrowed rear portion of the longitudinal slot means.

12. The sheath of claim 11, wherein the body means has a lower member with at least one drainage hole.

13. The sheath of claim 11 wherein the body means has a file connected to it.

14. The sheath of claim 11, wherein the body means has a construction of plastic.

15. In combination with a mason's trowel, the trowel having a flat blade with a length 1, a longitudinal axis, a handle connected to an upper surface of the blade, an improvement comprising:

a sheath having a length of at least 1;

the sheath having a receiving slot for the blade;

the sheath having an upper and a lower surface;

the upper surface having a longitudinal slot to receive a spine of the trowel;

the longitudinal slot having a stop to lock a rear end of the spine into the longitudinal slot; and wherein the lower surface further comprises at least one hole, thereby allowing water to drain therethrough.

16. In combination with a mason's trowel, the trowel having a flat blade with a length 1, a longitudinal axis, a handle connected to an upper surface of the blade, an improvement comprising:

a sheath having a length of at least 1;

the sheath having a receiving slot for the blade;

the sheath having an upper and a lower surface;

the upper surface having a longitudinal slot to receive a spine of the trowel;

the longitudinal slot having a stop to lock a rear end of the spine into the longitudinal slot; and wherein the sheath has a file connected to an outside surface thereof.

17. In combination with a mason's trowel, the trowel having a flat blade with a length 1, a longitudinal axis, a handle connected to an upper surface of the blade, an improvement comprising:

a sheath having a length of at least 1;

the sheath having a receiving slot for the blade;

the sheath having an upper and a lower surface;

the upper surface having a longitudinal slot to receive a spine of the trowel;

the longitudinal slot having a stop to lock a rear end of the spine into the longitudinal slot;

wherein the stop further comprises a narrowed rear portion of the longitudinal slot; and wherein the sheath has a file connected to an outside surface thereof.

18. The apparatus of claim 15, wherein the sheath has a file connected to an outside surface thereof.

19. A sheath for a mason's trowel, said sheath comprising:

a rectangular shaped block having a size larger than a trowel;

a slot in the block sized to receive a blade of the trowel without any prying open of the slot;

the sheath having an upper member with a longitudinal slot to receive a handle of the trowel;

the longitudinal slot having a narrowed rear portion which forms a pair of stops to lock a rear end of a spine of the trowel into the longitudinal slot; and wherein the sheath has a lower member with at least one drain hole.

20. A sheath for a mason's trowel, said sheath comprising:

a rectangular shaped block having a size larger than a trowel;

a slot in the block sized to receive a blade of the trowel without any prying open of the slot;

the sheath having an upper member with a longitudinal slot to receive a handle of the trowel;

the longitudinal slot having a narrowed rear portion which forms a pair of stops to lock a rear end of a spine of the trowel into the longitudinal slot; and wherein the sheath further comprises a file attached to an outer surface.

21. A sheath for a mason's trowel, the sheath comprising:

a body means functioning to protect a blade of a trowel;

a slot means at a rear end of the body means functioning to receive the blade of the trowel;

said body means having an upper member with a longitudinal slot means functioning to receive a spine of the trowel;

said longitudinal slot means further comprising a stop means functioning to prevent a rear end of the spine from passing through the stop means without a pushing force on the trowel; and wherein the body means has a lower member with at least one drainage hole.

22. A sheath for a mason's trowel, the sheath comprising:

a body means functioning to protect a blade of a trowel;

a slot means at a rear end of the body means functioning to receive the blade of the trowel;

said body means having an upper member with a longitudinal slot means functioning to receive a spine of the trowel;

said longitudinal slot means further comprising a stop means functioning to prevent a rear end of the spine from passing through the stop means without a pushing force on the trowel; and wherein the body means has a file connected to it.

* * * * *